United States Patent [19]

Flensburg et al.

[11] Patent Number: 4,976,420

[45] Date of Patent: Dec. 11, 1990

[54] METHOD FOR GATHERING SIGNATURES AND A GATHERING MACHINE FOR WORKING THE METHOD

[76] Inventors: Carl G. A. Flensburg, Grevegatan 31, Malmö , Sweden, S-216 17; Rolf H. V. Isaksson, Diakongatan 59, Malmö , Sweden, S-216 23

[21] Appl. No.: 288,257

[22] PCT Filed: Apr. 14, 1987

[86] PCT No.: PCT/SE87/00196

§ 371 Date: Dec. 16, 1988

§ 102(e) Date: Dec. 16, 1988

[87] PCT Pub. No.: WO87/06217

PCT Pub. Date: Oct. 22, 1987

[30] Foreign Application Priority Data

Apr. 18, 1986 [SE] Sweden ..... 8601784

[51] Int. Cl.[5] ..... B65H 39/02

[52] U.S. Cl. ..... 270/54; 271/100

[58] Field of Search ..... 270/54–58; 271/90–92, 96, 108, 100, 30 A, 5

[56] References Cited

U.S. PATENT DOCUMENTS

| | | | |
|---|---|---|---|
| Re. 21,489 | 6/1940 | Kleineberg | 270/54 |
| 3,949,978 | 4/1976 | Swanson | 270/54 |
| 4,491,311 | 1/1985 | Glanzmann | 270/54 |
| 4,706,950 | 11/1987 | Ruetschle | 270/54 |

FOREIGN PATENT DOCUMENTS

| | | | |
|---|---|---|---|
| 2648254 | 5/1977 | Fed. Rep. of Germany | 270/54 |
| 8007012-1 | 5/1983 | Sweden | 270/54 |

*Primary Examiner*—Edward K. Look
*Assistant Examiner*—Therese M. Newholm
*Attorney, Agent, or Firm*—Merchant, Gould, Smith, Edell, Welter & Schmidt

[57] ABSTRACT

Method of gathering signatures wherein signatures lying face to face in a stack and standing on the back edge, are fed to a delivery position with the face engaging an abutment (15). The signature (S1) in the delivery position is pushed up so that it projects from the stack at the opposite edge. Then, it is gripped at said edge so as to be carried by a continuous movement in an unchanged moving direction successively through the steps of being extracted from the stack, turned up-side-down and opened while being deposited upon a conveyor path (11). The invention also relates to a machine for gathering signatures comprising means (16) for feeding the signatures in the manner described above to the delivery position. A device (32) having carriers (33, 34) to be engaged with the face of the signature (S1) in the delivery position, can be reciprocated along the plane of the signature in the delivery position to lift said signature to a position wherein the opposite edge projects from the stack tangentially to one (22) of two drums (22, 23) forming part of the extraction means, said drums having grippers (26, 27, 28, 29) and being continuously rotated about parallel axes in opposite rotational directions.

6 Claims, 5 Drawing Sheets

METHOD FOR GATHERING SIGNATURES AND A GATHERING MACHINE FOR WORKING THE METHOD

Figure 1:
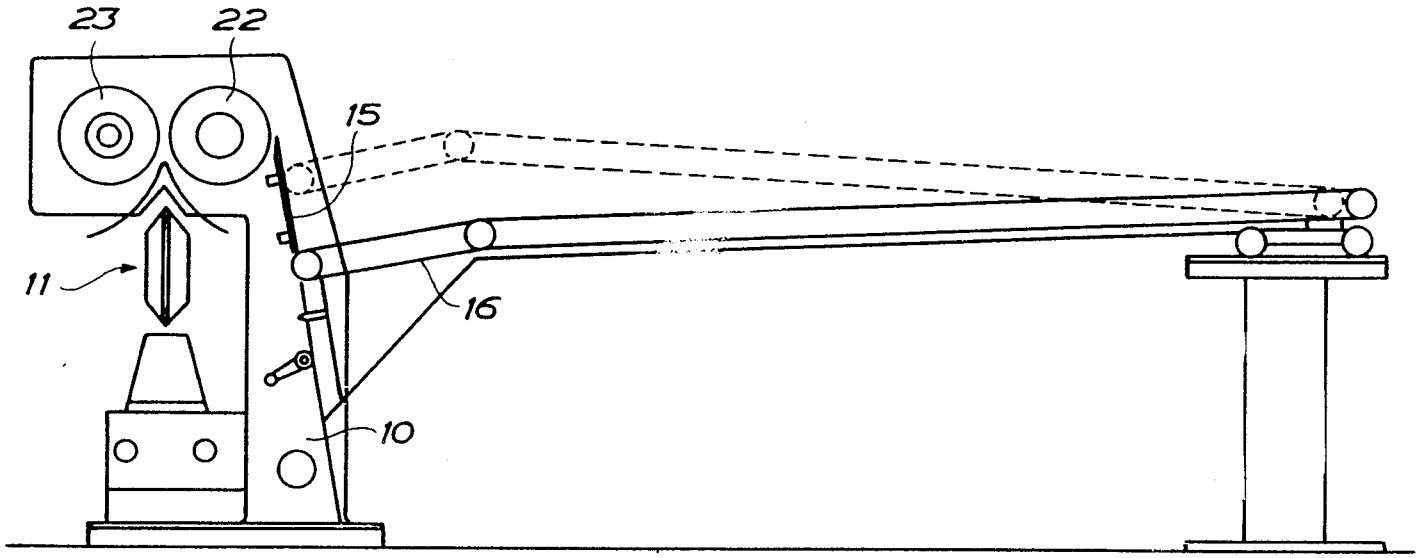

The invention relates to a method for gathering signatures and to a gathering machine for working the method.

In the method of the invention, the signatures lying face to face in a stack and standing on the back edge, are fed to a delivery position with the face engaging an abutment, and the signature engaging the abutment is gripped and is extracted from the delivery position so as to be opened and positioned straddlewise on a conveyor path.

In prior art gathering machines operating according to this principle, the signature in the delivery position is extracted from the stack by the signature being gripped at the back edge by a rotating transfer drum, and is then carried against a stop by means of the drum in order that the signature shall then be gripped by two opening drums rotating continuously about axes which are parallel to the axis of the transfer drum, and shall be drawn in the opposite moving direction by these opening drums and, while the signature is being opened, shall be deposited upon the conveyor path.

GB-A-1,311,151 describes a machine for handling signatures, which includes opening drums for extracting the signatures from a stop.

In such machines, a high noise level arises due to the fact that the signatures hit the stop, and additionally the operating speed is limited by the change of moving direction of the signature. Moreover, the stop must be adjusted to different sizes. In addition to these functional drawbacks there is the further drawback that the machine is of a complicated construction due to the presence of three co-operating drums, the transfer drum and the two opening drums.

The purpose of the invention is to provide a faster and more reliable gathering of the signatures by using simpler and more dependable apparatus than that available today.

For said purpose the method of the invention is characterized in that the signature in the delivery position is pushed up to project upwards at the opposite edge from the stack and is then gripped at said edge so as to be carried by a continuous movement in an unchanged moving direction successively through the steps of being extracted from the stack, turned upside-down and opened while being deposited upon the conveyor path.

For working the method the invention also provides a machine for gathering signatures, comprising means for feeding the signatures lying face to face in a stack and standing on the back edge thereof, to a delivery position with the face engaging an abutment, and means for extracting the signature engaging the abutment, from the delivery position. The gathering machine is characterized in that a device having carriers to be engaged with the face of the signature in the delivery position, can be reciprocated along the plane of said signature to lift the signature to a position wherein the opposite edge projects from the stack tangentially to one of two drums forming part of the extraction means, said drums having grippers and being continuously rotated about parallel axes in opposite rotational directions.

Figure 2:
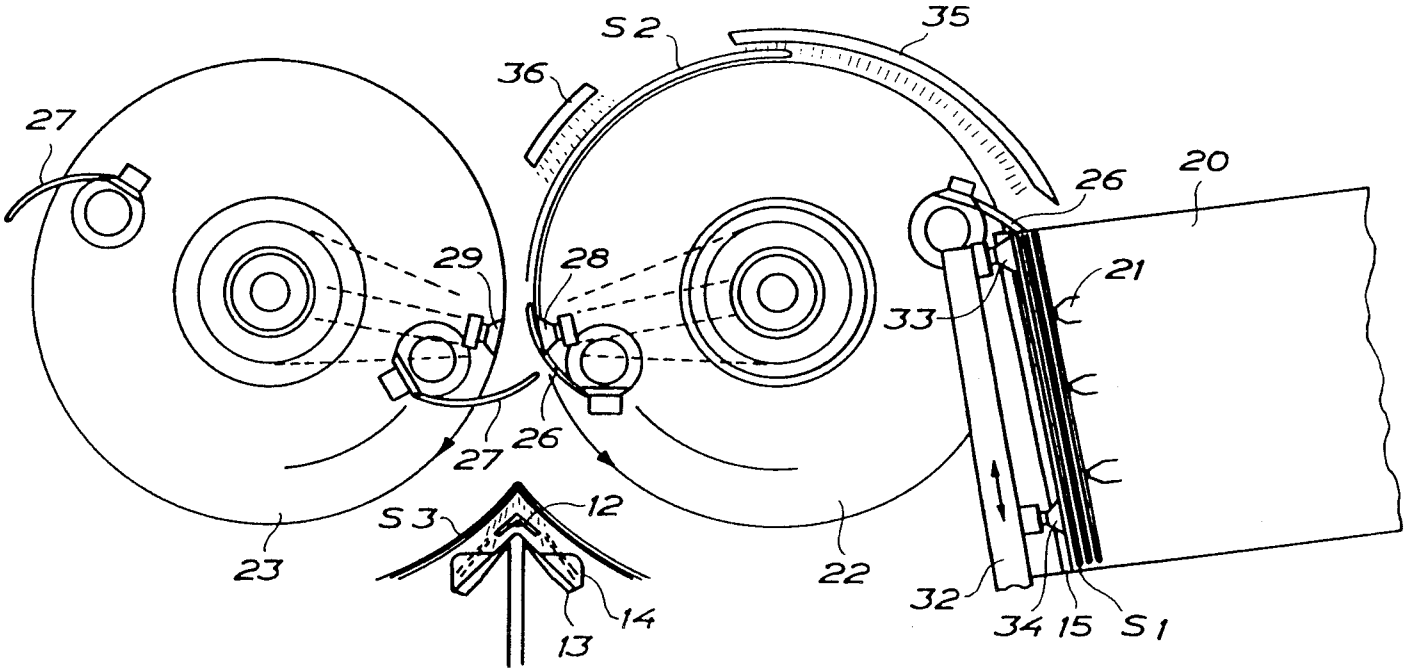
Figure 3:
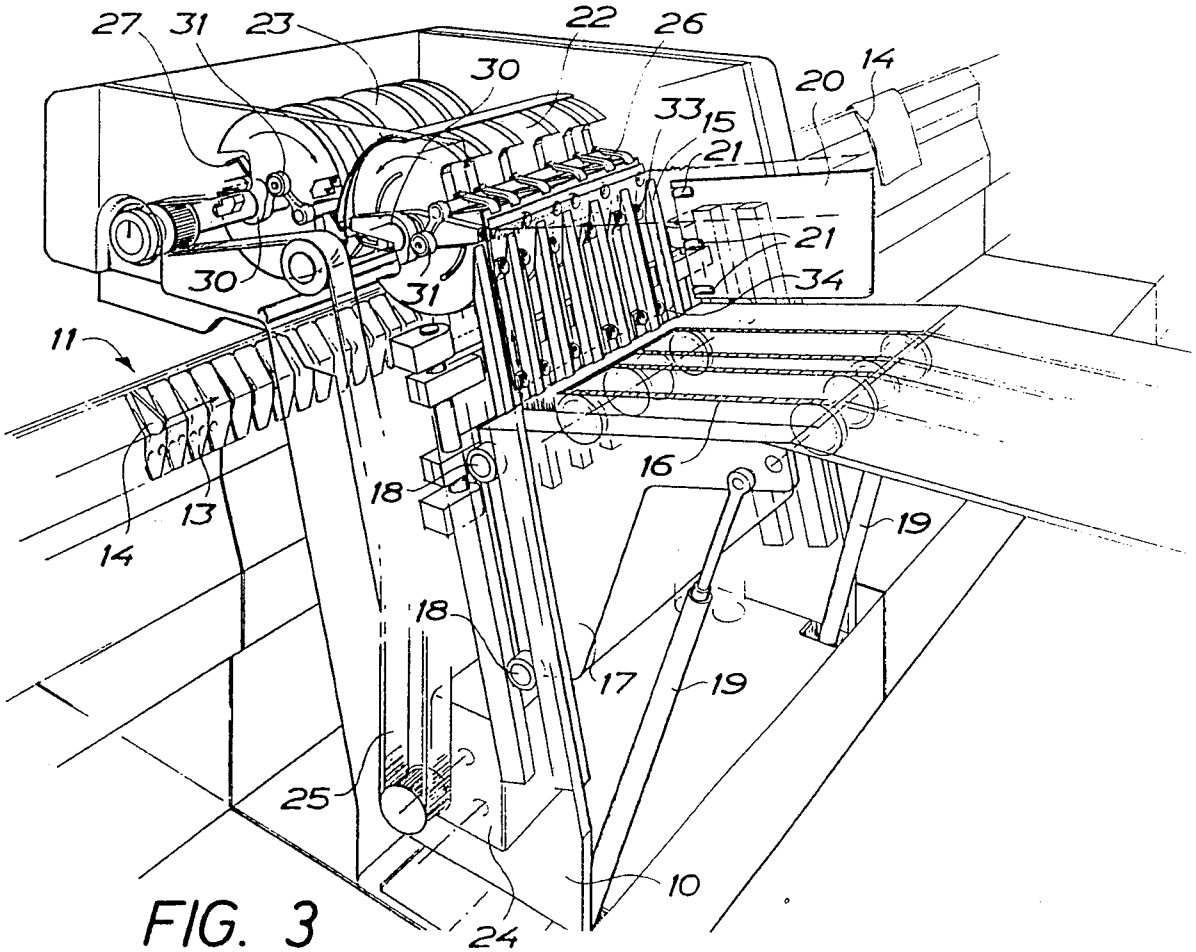
Figure 4:
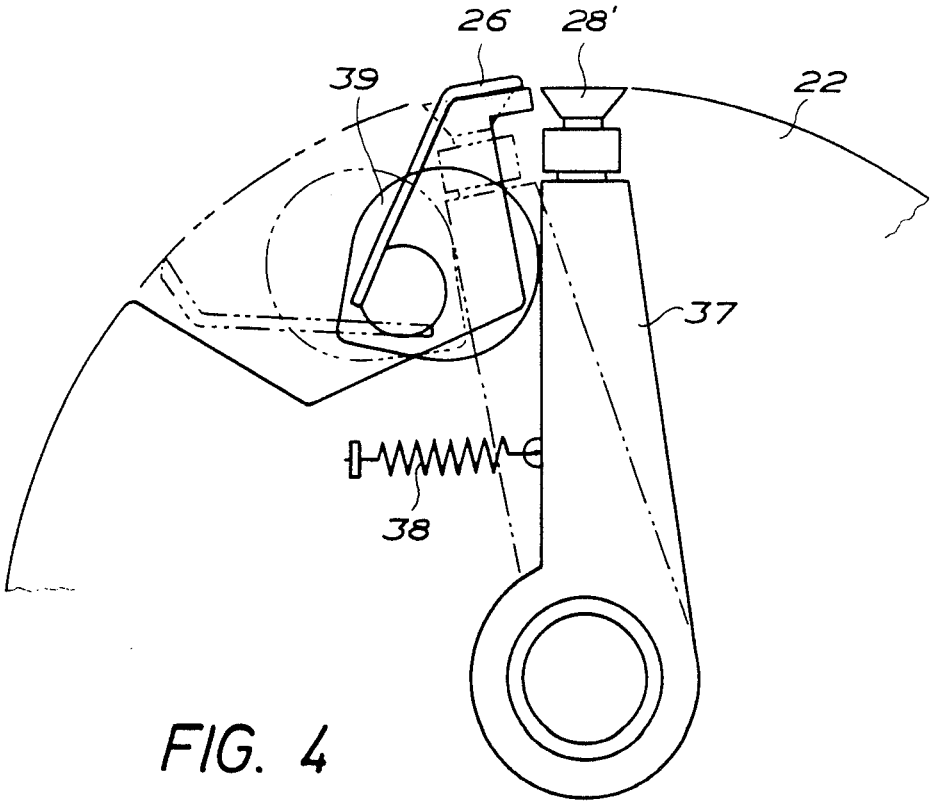
Figure 5:
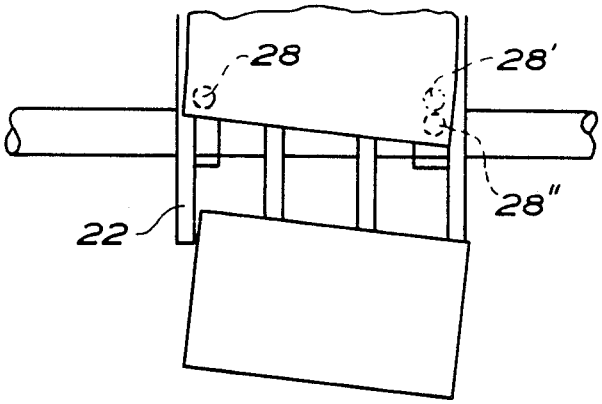
Figure 6:
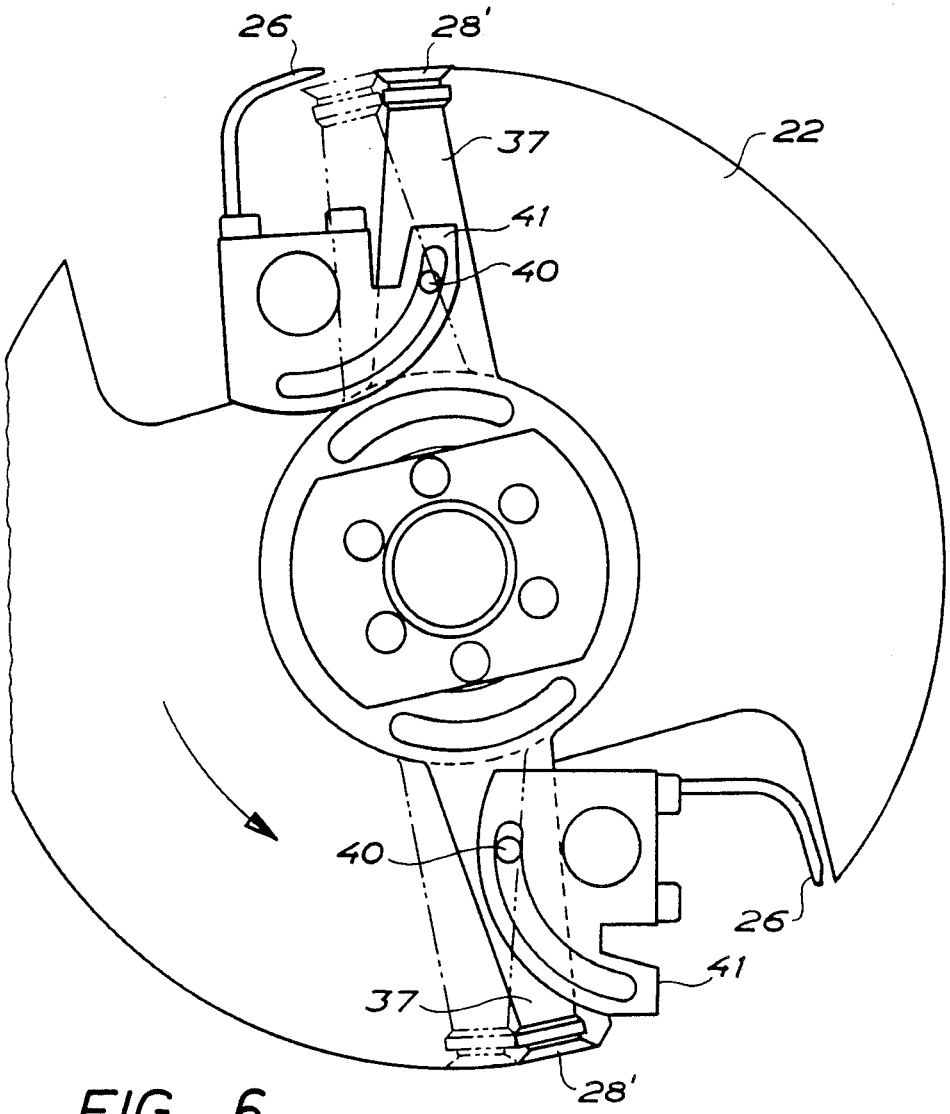

In order to illustrate the invention this will be described in more detail below with reference to the accompanying drawings in which FIG. 1 is a somewhat diagrammatic side view of a gathering machine for working the method of the invention, FIG. 2 is an enlarged view, also somewhat diagrammatic, of the essential functional elements of the gathering machine, FIG. 3 is a perspective view of a constructive embodiment of the gathering machine, FIG. 4 is a fragmentary side view of one of the opening drums in a modified embodiment of the gathering machine, FIG. 5 is a plan view on a reduced scale of the opening drum in FIG. 4 and illustrates the function thereof, and FIG. 6 is a view corresponding to that in FIG. 4 of one of the opening drums in another modified embodiment but for the same function as that illustrated in FIG. 5.

The gathering machine comprises a frame 10 and is positioned adjacent a conveyor path 11 for gathering signatures on said conveyor path which in a known manner comprises a saddle rail 12 and a conveyor chain which is moving along said rail, said chain having carriers 14, FIGS. 2 and 3. In the frame, an abutment 15 is provided and for feeding signatures to this abutment a conveyor 16 is provided which is constructed as an endless belt conveyor and can be adjusted vertically to accommodate signatures of different sizes. Said one end of the conveyor is supported by a bracket 17 which is displaceably guided by means of rollers 18 in guides in the frame 10 and can be raised and lowered by adjustment means 19. The signatures can be positioned as a stack on the conveyor 16, i.e. the signatures are closely stacked face to face. In the present case they shall have the back edge facing downwards against the conveyor. In side walls 20 guiding the signatures laterally on the conveyor resilient fingers 21 are provided which relieve the pressure against the signatures adjacent the abutment 15; see FIG. 2. The signatures can be fed against the abutment continuously and at a speed which is adjusted to the operating speed of the gathering machine and to the thickness of the signatures. This adjustment can be effected automatically or manually by using known means. However, the signatures can also be supplied in another manner than as a stack. For example, they can be supplied as a roll in which the signatures are stored partly overlapping each other between the windings of a wound web of tissue or the like.

Irrespective of the manner of supplying the signatures they should be gripped one after the other as they arrive at the abutment 15 to be positioned by means of the gathering machine upon the conveyor path 11, which is the function and purpose of the gathering machine. The gathering machine comprises two opening drums 22 and 23 which can be rotated about mutually parallel horizontal axes extending substantially in parallel to the abutment 15, and these drums are connected to a drive motor 24 by means of an endless toothed belt 25 to be driven synchronously in opposite directions, drum 22 counter-clockwise and drum 23 clockwise. Both drums have mechanical grippers 26 and 27, respectively, and suction cups 2S and 29, respectively, the mechanical grippers being controlled by stationary but to different angular positions adjustable cam disks 30 over cam followers 31 so as to be opened and closed in defined angular positions at the rotation of the drums, and the suction cups can be connected to a suction conduit in the shafts of the drums so as to be put under vacuum in defined angular positions of the drums by the connection between the suction conduits and the suction cups being controlled in dependence on the rotation of the drums, by valve means of known art. On each cylinder, two sets of grippers and suction cups are provided in the present case, but it is possible to provide a single set or more sets than two.

In order that the signature engaging the abutment 15 in the delivery position can be gripped by the drum 22 it must be pushed up so that the "lip", i.e. the edge of the signature which is opposite to the back, will be exposed and will be available so as to be gripped by means of the grippers on the drum 22. Behind the abutment 15 a frame 32 is provided for this purpose, which can be displaced up and down along the abutment 15 and is provided with upper and lower suction cups 33 and 34, respectively. The abutment 15 comprises vertically arranged bars mutually spaced as shown in FIG. 3, so that the suction cups 33, 34 through the spaces between the bars can be engaged with the signature which is in the delivery position and engages the abutment. The frame is driven up and down synchronously with the rotation of the drums in order that the suction cups will be engaged with the signature in the delivery position and will push it up along the abutment to a position above the other signatures on the conveyor 16 exactly at the moment when a gripper on the drum 22 passes the upper edge of the signature. As will be seen from the drawings, the abutment is substantially tangential to the drum 22 so that the signature will be moved tangentially towards the drum.

Due to the fact that mechanical grippers as well as suction cups are provided on the drums it is possible for the gathering machine to handle with full safety and precision signatures of different types, lap signatures having one or more sheets, as well as multifolded signatures having a closed head.

For undisturbed extraction of the signatures it is essential that the signatures have the upper edge at a common level, which can be achieved more easily when the signatures stand with the back against the conveyor, but if a signature nevertheless should project from the other signatures, the position thereof can be corrected by activating the lower suction cups 34 on the frame 25 during the downward return movement of the frame to be engaged at low vacuum with the following signature and draw said signature downwards to the correct position with the back engaging the conveyor 16 so that all signatures will be given the same starting position (levelling).

When the signature which engages the abutment 15, said signature being indicated at Sl, has been gripped by the drum 22 it will be extracted from the stack, which is effected by means of the mechanical grippers 26 on the drum 22, and will then be carried half a revolution about the axis of the drum 22 to come into the nip of the drums 22 and 23 where the signature is indicated at S2. One half of the signature is now gripped by the drum 23, the other half being retained by the drum 22, so that the signature will be opened, the signature at the same time being moved downwards towards the conveyor path 11. The grippers of the drums will release the signature, now indicated at S3, in time to allow the signature to fall by gravity onto the conveyor path. From the moment when the signature is gripped in the stack to the moment when it arrives at the conveyor path the signature accordingly has moved continuously in one and the same direction along a circular arc with the back edge as the trailing edge, the signature at the same time being turned upside-down and being opened. In order that the signature will not open as it is carried along over half a revolution of the drum 22 and at the same time is turned around so that the back which initially was facing downwards, will face upwards, guide rails 35 and 36 can be provided adjacent but spaced from the curved surface of the drum 22, and possibly these rails can be provided with air nozzles directed towards the drum.

The saddle rail 12 of the conveyor path may be provided with air nozzles which are directed upwards in order that the air shall facilitate opening of the signatures which consist of a difficult material, and also shall attenuate the fall of the signatures onto the conveyor path. These air nozzles can also form part of a system for supervising the operation of the gathering machine, because the positioning of signatures on the conveyor path can be sensed as pressure changes in the air system and can be utilized so as to shut off the gathering machine if signature are not received in a regular sequence by the conveyor path.

An essential advantage of the gathering machine described is that the operating steps are well recognized and easily can be supervised. A further essential advantage is that an apparatus for gluing loose sheets or cards to the signature can be located on top of the gathering machine, because the signatures are available on the upper side of the drum 22, and easily can be driven from the gathering machine.

For some products the drums can handle signatures by using only one of the grippers while other products require that the drums operate alternatingly with the grippers and the suction cups when completing an extraction and gathering cycle.

Multifolded signatures (having closed heads) which have no lap and can be handled by the gripper/suction cup combination on the opening drums, can arrive in a wrong position at the conveyor path by the sheets of the signature spread at the end of the signature which is opposite to the closed head of the signature, when the signature is falling down onto the conveyor path. In order to avoid this the signature can be adjusted to an angled position during gathering. In FIGS. 4 and 5 an embodiment is shown by means of which this can be achieved. The suction cups 28 at the left side of the drum 22, FIG. 5, where said end of the signature which is opposite to the closed head, is supposed to be positioned, are mounted in a fixed position on the drum as in the embodiment described. The suction cups at the right side, where the closed head is located, one of said cups being indicated at 28', are mounted for displacement in relation to the drum in the rotational direction thereof after the signature having been extracted from the stack. The suction cup 28' is supported by an arm 37 which can be pivoted about the rotational axis of the drum 22, and it is kept engaged with a cam disk 39 by a tension spring 38, said cam disk being connected with the mechanical gripper 26 to be rotated when the mechanical gripper is pivoted from the closed position shown by solid lines to the open position shown by dot-and-dash lines. By the cam being rotated the arm 37 will be pivoted counter-clockwise in relation to the drum 22 as seen in FIG. 4, i.e. in the rotational direction of the drum 22 so that the arm will take the position shown by dot-and-dash lines in FIG. 4, and the suction cup 28' will be moved to the position 28″ in FIG. 5, i.e. it will be displaced peripherally on the drum in relation to the suction cup 28. It follows that the signature gripped by the suction cups only will be adjusted to an angled position so that the signature will hang down at one end thereof. The signature has the closed head at this end, which eliminates the risk that the signature lands unsymmetrically on the conveyor path due to spreading of the individual sheets when the signature is falling down and that the signature as a consequence thereof does not land in the centre fold on the saddle. The suction cup 28′ will be returned against the bias of the spring to the position shown by solid lines, when the gripper 26 grips a new signature for extraction.

The moving direction of the conveyor chain 13 is indicated by an arrow in FIG. 5. As will be seen, the carriers thereof shall engage the closed head of the signature which has been laid down.

In order to control the angular adjustment so that it can be increased or decreased there can be provided at the side of the arm 37 where the tension spring 28 is located, a stationary adjustable abutment, e.g. a set screw which defines the end position of the arm in the counter-clockwise direction. When the arm has engaged the abutment, the continued rotation of the cam disk 39 thus will cause no further pivotal movement of the arm 37; the cam disk will disengage the arm.

The embodiment in FIG. 6 is for the same function as the embodiment of FIG. 5, but the mechanical device for the relative pivotal movement of the suction cup 28′ is different. The arm 37 is guided by a pin 40 in a coulisse 41 on the gripper 26 so that a corresponding movement as that in FIG. 5 will be imparted to the arm.

In the present case, two suction cups are provided at each end of the drum 22. Then, the two suction cups at one end shall of course be mounted for individual pivotal movement in relation to the drum in response to the movement of the associated mechanical gripper.

We claim:

1. A method of gathering signatures comprising the steps of:

feeding a plurality of signatures, lying face to face in a stack with each signature in said stack standing on a back edge thereof, to a delivery position with a face of a leading signature in said stack engaging an abutment, displacing said leading signature engaging said abutment in a direction transverse to said stack so as to project an edge of said leading signature which is opposite to said back edge above said stack, gripping said projecting edge of said leading signature, extracting said gripped signature from said stack and carrying it away from said delivery position by a continuous movement in an unchanged moving direction, turning said signature upside-down during said continuous movement, angling said signature during said extracting and turning movement, and depositing said signature straddlewise on a conveyer path with one end of said signature leading.

2. Method as in claim 1 wherein the gripped signature, when extracted, is caried in a circular path to be opened after having moved over substantially half a revolution.

3. A machine for gathering signatures comprising:

a means for feeding a signature to a delivery position from a stack of signatures which are lying face to face and standing on a back edge thereof, an abutment for engaging a face of a leading signature in the stack, a means for extracting the leading signature engaging the abutment from the delivery position comprising a pair of rotating drums having grippers wherein the drums rotate about substantially parallel axes in opposite rotational directions, a device having carriers for engaging the face of the signature engaging the abutment, the device reciprocal along the plane of said signature to displace the signature to a position wherein an edge of the signature opposite the back edge thereof projects from the stack tangentially to a first of the drums, first suction cups at a first end of the first drum which is operable in conjunction with the first drum for retaining the signature on the first drum with the grippers associated with the first drum in an open position, second suction cups at a second end of the first drum wherein the second end is opposed to the first end, and a means for mounting said first suction cups so as to provide for displacement in the peripheral direction of the drum in relation to said second suction cups and thereby provide for angular adjustment of the signature held by the first and second suction cups.

4. Machine as in claim 3 wherein said first suction cups are operatively connected with an associated mechanical gripper to be displaced in response to the opening and closing movement of the mechanical gripper.

5. Machine as in claim 3 wherein at least one guiderail is mounted along the curved surface of said first drum spaced therefrom.

6. Machine as in claim 5 wherein air nozzles are provided on the guide rail and the nozzles are directed towards the surface of the drum.

* * * * *

UNITED STATES PATENT AND TRADEMARK OFFICE

CERTIFICATE OF CORRECTION

PATENT NO. : 4,976,420

DATED : December 11, 1990

INVENTOR(S) : Carl G.A. Flensburg et al.

It is certified that error appears in the above-identified patent and that said Letters Patent is hereby corrected as shown below:

Title page item [57] Abstract, line 9,
please delete "up-side" and substitute therefore --upside--

In Column 2, line 65,
please delete "2S" and substitute therefore --28--

In Column 4, line 23,
please delete "signature" and substitute therefore --signatures--

In Claims, column 6, line 10,
please delete "caried" and substitute therefore --carried--

Signed and Sealed this

Fourteenth Day of July, 1992

*Attest:*

DOUGLAS B. COMER

*Attesting Officer*

*Acting Commissioner of Patents and Trademarks*